US005824461A

United States Patent [19]

Schell et al.

[11] Patent Number: 5,824,461

[45] Date of Patent: Oct. 20, 1998

[54] FLUOROPOLYETHER CONTAINING AQUEOUS COATING COMPOSITIONS FOR AN IMAGING ELEMENT

[75] Inventors: Brian A. Schell, Honeoye Falls; Michael W. Orem, Rochester; Yongcai Wang, Penfield, all of N.Y.

[73] Assignee: Eastman Kodak Company, Rochester, N.Y.

[21] Appl. No.: 932,014

[22] Filed: Sep. 17, 1997

[51] Int. Cl.[6] ..... G03C 1/89; G03C 1/76

[52] U.S. Cl. ..... 430/529; 430/531; 430/533; 430/536; 430/637; 430/961

[58] Field of Search ..... 430/531, 637, 430/961, 529, 533, 536

[56] References Cited

U.S. PATENT DOCUMENTS

| | | | |
|---|---|---|---|
| 3,018,272 | 1/1962 | Griffing et al. | 260/75 |
| 3,929,489 | 12/1975 | Arcesi et al. | 430/302 |
| 4,307,374 | 12/1981 | Noonan et al. | 430/215 |
| 4,330,618 | 5/1982 | Minamizono et al. | 430/961 |
| 4,419,437 | 12/1983 | Noonan et al. | 430/631 |
| 4,497,917 | 2/1985 | Upson et al. | 523/201 |
| 4,612,279 | 9/1986 | Steklenski et al. | 430/531 |
| 4,735,976 | 4/1988 | Steklenski et al. | 524/32 |
| 5,366,855 | 11/1994 | Anderson et al. | 430/527 |
| 5,380,644 | 1/1995 | Yonkoski et al. | 430/637 |
| 5,446,205 | 8/1995 | Marchionni et al. | 568/603 |
| 5,447,832 | 9/1995 | Wang et al. | 430/523 |
| 5,643,971 | 7/1997 | Roenigk | 523/122 |

*Primary Examiner*—Richard L. Schilling
*Attorney, Agent, or Firm*—Carl F. Ruoff

[57] ABSTRACT

The present invention is an imaging element which includes a support, and at least one imaging layer superposed on the support. A protective overcoat is superposed on the support, and is formed by coating and subsequent drying of an aqueous coating composition having therein colloidal polymer particles having a glass transition temperature of greater than 20° C. and a fluoropolyether including more than 90 mole % units selected from the group consisting of —$CF_2$—$CF_2$—O—, —$CF_2$—O—, —$CF(CF_3)$—O—, and —$CF_2$—$CF(CF_3)$—O—, and a functional group selected from the group consisting of COOH, —$CH_2$—OH, —$CH_2$—COOH, —$CH_2$—$SO_3H$, —$CH_2$—$PO_3H$, —($CH_2$—$CH_2$—O)—H, and —($CH_2$—$CH(CH_3)$—O—)—H. The present invention includes the imaging element produced from the coating composition.

21 Claims, No Drawings

FLUOROPOLYETHER CONTAINING AQUEOUS COATING COMPOSITIONS FOR AN IMAGING ELEMENT

CROSS REFERENCE TO RELATED APPLICATIONS

This application relates to commonly assigned copending application Ser. No. 08/932,597, filed simultaneously herewith and hereby incorporated by reference for all that it discloses.

FIELD OF THE INVENTION

This invention relates to an image element which comprise a protective overcoat layer containing a fluoropolyether. In particular, the invention relates to a protective overcoat layer with excellent water repellent properties comprising a fluoropolyether and a colloidal polymer particle.

BACKGROUND OF THE INVENTION

Layers of imaging elements other than the imaging layer itself are often referred to as auxiliary layers. A typical auxiliary layer application is as a protective overcoat layer that provides resistance to scratches, abrasions, blocking, ferrotyping, dust, attacks by water, and stains from coffee, tea, etc. An overcoat protective layer, as a backing layer for photographic applications must also be chemically impermeable to processing solutions when employed as a barrier layer for an underlying antistatic layer in order to maintain post-process conductivity. Backing layers for photographic applications are employed as very thin layers, typically less than one micron, making film formation quality of critical importance. In addition, such layers must not adversely affect the sensitometric response of the imaging layer or reduce the transparency of the processed film.

Glassy, hydrophobic polymers such as polyacrylates, polymethacrylates, polystyrenes, or cellulose esters are often employed as protective overcoat layers for imaging elements because of their desirable chemical and physical properties. These are most often coated from organic solvent-based solutions. For example, U.S. Pat. Nos. 4,612,279 and 4,735,976 describe organic solvent-applied protective overcoats for antistatic layers comprising a blend of cellulose nitrate and a copolymer containing acrylic or methacrylic acid. However, because of environmental considerations, it is desirable to replace organic solvent-based coating formulations with water-based coating formulations. The challenge has been to develop water-based coatings that provide similar physical and chemical properties in the dried film to those obtained with organic-solvent based coatings.

Water insoluble polymer particles contained in aqueous latexes and dispersions reported to be useful for coatings on photographic films typically have low glass transition temperatures (Tg) to insure coalescence of the polymer particles into a strong, continuous film. Generally the Tg of such polymers is less than 50° C. Typically these polymers are used in priming or "subbing" layers which are applied onto the film support to act as adhesion-promoting layers for photographic emulsion layers. Such low Tg polymers, although useful when they underlay an emulsion layer, are not suitable as, for example, backing layers since their blocking and ferrotyping resistances are poor. Alternative approaches that have been described in the prior art to overcome these difficulties include, for example, the use of a layer comprising polymer latices of high glass transition temperatures (Tg) in which the film is formed in the presence of a coalescing aid, a layer comprising core-shell latex polymer particles in which a soft (low Tg) shell allows the polymer particle to coalesce and a hard (high Tg) core provides the desirable physical properties as described in U.S. Pat. No. 4,497,917, incorporated herein by reference, a layer comprising a mixture of film-forming colloidal polymer particles, including polyurethane dispersions, and non-film forming colloidal polymer particles as described in U.S. Pat. Nos. 5,447,832, 5,366,855, and 5,643,971, incorporated herein by reference, a layer comprising polyurethane particles as described in U.S. patent application Ser. No. 08/576,796 and a layer comprising polyurethane/vinyl polymer particles as described in U.S. patent application Ser. No. 08/854,572, incorporated herein by reference.

Although the layers prepared in accordance with the above prior art possess the mechanical attributes required of a protective overcoat layer, they are easily attacked by water due to the presence of hydrophilic groups and/or surfactants which are necessary to disperse and stabilize these polymer particles. This causes problems, for example, in drying a photographic element in photoprocessing equipment—particularly in processors with limited drying capacity—as excess solution adheres to the backing layer as film exits the processor, causing sticking between laps of the take-up spool. During use or display of an imaging material, its surface can easily be contaminated and damaged by contact with water or coffee spills. The degree of the damage or contamination increases if the surface of the imaging material is easily wetted by water. One way to measure water wettability is by water contact angle. A typical layer prepared in accordance with the above prior art has a water contact angle below 60°.

A foremost objective of the present invention is to provide an improved protective overcoat layer composition that not only possesses all the mechanical attributes as described in the prior art, but also has excellent water repellent properties.

SUMMARY OF THE INVENTION

The present invention is an imaging element which includes a support, and at least one imaging layer superposed on the support. A protective overcoat is superposed on the support, and is formed by coating and subsequent drying of an aqueous coating composition having therein colloidal polymer particles having a glass transition temperature of greater than 20° C. and a fluoropolyether including more than 90 mole % units selected from the group consisting of $—CF_2—CF_2—O—$, $—CF_2—O—$, $—CF(CF_3)—O—$, and $—CF_2—CF(CF_3)—O—$, and a functional group selected from the group consisting of COOH, $—CH_2—OH$, $—CH_2—COOH$, $—CH_2—SO_3H$, $—CH_2—PO_3H$, $—(CH_2—CH_2—O)—H$, and $—(CH_2—CH(CH_3)—O—)—H$.

The present invention includes the imaging element produced from the coating composition. In a preferred embodiment the imaging element is a photographic element.

DESCRIPTION OF THE INVENTION

The imaging elements of this invention can be of many different types depending on the particular use for which they are intended. Such elements include, for example, photographic, electrophotographic, electrostatographic, photothermographic, migration, electrothermographic, inkjet receiving paper, dielectric recording and thermal-dyetransfer imaging elements. Photographic elements can comprise various polymeric films, papers, glass, and the like, but both acetate and polyester supports well known in the art are preferred. The thickness of the support is not critical. Support thickness of 2 to 10 mils (0.06 to 0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

Coating compositions for forming the protective overcoat layers in accordance with this invention comprises a continuous aqueous phase having therein a fluoropolyether and a colloidal polymer particle having a glass transition temperature of greater than 20° C. and a mean size of greater than 10 nm. The colloidal polymer particles include those prepared by aqueous emulsion polymerization techniques and those formed by dispersing preformed polymers, especially preformed condensation polymers such as polyesters, polyurethanes, epoxides, polyamides, and the like. The colloidal polymer particles also include those formed by free radical polymerization of vinyl monomers in the presence of a polyurethane dispersion. Other additional compounds may be added to the coating composition, depending on the functions of the particular layer, including surfactants, emulsifiers, coating aids, matte particles, rheology modifiers, crosslinking agents, inorganic fillers such as conductive and nonconductive metal oxide particles, pigments, magnetic particles, biocide, and the like. The coating composition may also include a small amount of organic solvent, preferably the concentration of the organic solvent is less than 1 percent by weight of the total coating composition.

The fluoropolyether useful for the practice of the invention include those comprising more than 90 mole % unites selected from: $—CF_2—CF_2—O—$, $—CF_2—O—$, $—CF(CF_3)—O—$, and $—CF_2—CF(CF_3)—O—$, and a functional group selected from: COOH, $—CH_2—OH$, $—CH_2—COOH$, $—CH_2—SO_3H$, $—CH_2—PO_3H$, $—(CH_2—CH_2—O)—H$, and $—(CH_2—CH(CH_3)—O—)—H$. The fluoroether part provides the protective overcoat with good water repellent properties, and the functional group part allows the compound to be readily dispersed in aqueous phase and to remain anchored to the protective overcoat surface through different treatment processes and during application. Such compounds can be made by processes as described in U.S. Pat. No. 5,446,205, herein incorporated by reference, preferably have a molecular weight of about 300 to 5000. These fluoropolyether compounds are, for example, Fomblin MF series manufactured by Ausimount Inc. including Fomblin MF 201, Fomblin MF 402, Fomblin MF 403, and Fomblin MF 300, and Fluorolink series including Fluorolink C, Fluorolink D, Fluorolink E, and Fluorolink T. Preferably, the fluoropolyether compounds are carboxylic acid terminated fluoropolyether such as, for example, Fomblin MF 300 and Fluorolink C. The actual application amount of the fluoropolyether is about 0.01 to 10 parts by weight per 100 parts by weight of the total dry coating, preferably about 0.05 parts to 5 parts by weight per 100 parts by weight of the total dry coating, and most preferably about 0.1 parts to 2 parts by weight per 100 parts by weight of the total dry coating.

The emulsion polymerization process which can be used to prepare the colloidal polymer particles of this invention is well-known in the art (see, for example, Padget, J. C. *in Journal of Coating Technology,* Vol 66, No. 839, pages 89–105, 1994; El-Aasser, M. S. and Fitch, R. M. Ed. *Future Directions in Polymer Colloids,* NATO ASI Series, No 138, Martinus Nijhoff Publishers, 1987; Arshady, R. *Colloid & Polymer Science,* 1992, No 270, pages 717–732; Odian, G. *Principles of Polymerization,* 2nd Ed. Wiley(1981); and Sorenson, W. P. and Campbell, T. W. *Preparation Method of Polymer Chemistry,* 2nd Ed, Wiley (1968)). The polymerization process is initiated with free radical initiators. Free radicals of any sort can be used. Preferred initiators include those already described. Surfactants that can be used include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Ethylenically unsaturated monomers which can be used to prepare the polymer particles of the invention may include, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Ethylenically unsaturated monomers containing carboxylic acid groups that can be incorporated into the polymer particles of the invention include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid.

Crosslinking comonomers can be used in the emulsion polymerization to lightly crosslink the polymer particles. It is preferred to keep the level of the crosslinking monomers low so as not to affect the polymer film forming characteristics. Preferred crosslinking comonomers are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The colloidal polymer particles of this invention can have different microstructures and chemical heterogeneity. For example, it can have a core/shell structure. The core and shell can have different glass transition temperatures and chemical compositions.

The preparation of aqueous polyurethane dispersions is well known in the art. All the preparation methods share two common features. In all cases, the first step is the formation of a medium molecular weight isocyanate terminated prepolymer by the reaction of suitable di or polyol with a stochiometric excess of di or polyisocyanate. The polymer to be dispersed in water is functionalized with water-solubilizing/dispersing groups which are introduced either into the prepolymer prior to chain extension, or are introduced as part of the chain extension agent. Therefore, small particle size stable dispersions can frequently be produced without the use of an externally added surfactant.

In the solution process, the isocyanate terminated polyurethane prepolymer is chain extended in solution in order to prevent an excessive viscosity being attained. The preferred solvent is acetone, and hence this process is frequently referred as the acetone process. The chain extender can, for example, be a sulphonate functional diamine, in which case the water-solubilizing/dispersing group is introduced at the chain extension step. The chain extended polymer is thus more properly described as a polyurethane urea. Water is then added to the polymer solution without the need for high shear agitation, and after phase inversion a dispersion of polymer solution in water is obtained.

In the prepolymer mixing process, a hydrophilically modified isocyanate terminated prepolymer is chain extended with diamine or polyamine at the aqueous dispersion step. This chain extension is possible because of the preferential reactivity of isocyanate groups with amine rather than with water. In order to maintain this preferential reactivity with amine, it is necessary to prevent the water temperature from exceeding the value at which significant reactions occur between water and the isocyanate. The choice of isocyanates is clearly important in this respect. The prepolymer mixing process is extremely flexible in terms of the range of aqueous polyurethane ureas which can be prepared, and has the major advantages that it avoids the use of large amounts of solvent and avoids the need for the final polymer to be solvent soluble.

The ketamine/ketazine process can be regarded as a variant of the prepolymer mixing process. The chain-extending agent is a ketone-blocked diamine (ketamine) or ketone-blocked hydrazine (ketazine) which is mixed directly with the isocyanate terminated polyurethane prepolymer. During the subsequent water dispersion step, the ketamine or ketazine is hydrolyzed to generate free diamine or hydrazine respectively, and thus quantitative chain extension takes place. An advantage of the ketamine process over the prepolymer mixing process is that it is better suited for preparing aqueous urethanes based on the more water reactive aromatic isocyanates.

The hot melt process involves the capping of a functionalized isocyanate terminated polyurethane prepolymer with urea at >130° C. to form a biuret. This capped polyurethane (which can be solvent free) is dispersed in water at about 100° C. to minimize viscosity, and chain extension carried out in the presence of the water by the reaction with formaldehyde which generates methylol groups, which in turn self-condense to give the desired molecular weight buildup.

Anionic, cationic, or nonionically stabilized aqueous polyurethane dispersions can be prepared. Anionic dispersions contain usually either carboxylate or sulphonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized aqueous polyurethanes can be prepared by the use of diol or diisocyanate co-monomers bearing pendant polyethylene oxide chains. Such polyurethane dispersions are colloidally stable over a broad pH range. Combinations of nonionic and anionic stabilizations are sometimes utilized to achieve a combination of small particle size and strong stability.

Polyols useful for the preparation of polyurethane dispersion of the present invention include polyester polyol prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanate that can be used are as follows: toulene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines which are used to neutralize the acid and form an anionic group for water dispersability are trimethylamine, triethylamine, dimethylaniline, diethylaniline, triphenylamine and the like.

Diamines suitable for chain extension of the polyurethane include ethylenediamine, diaminopropane, hexamethylene diamine, hydrazine, amnioethylethanolamine and the like.

Water dispersible polyesters are polyesterionomers that contain at least one ionic moiety. These polyesters are prepared by reacting one or more dicarboxylic acids or their functional equivalents such as anhydrides, diesters, or diacid halides with one or more diols in melt phase polycondensation techniques as described in U.S. Pat. Nos. 3,018,272, 3,929,489, 4,307,174, 4,419,437, incorporated herein by reference. Examples of this class of polymers include, for example, Eastman AQ Polyesterionomers, manufactured by Eastman Chemical Co.

The polyurethane/vinyl polymer dispersions of the present invention are prepared in an analogous manner to conventional polyurethane dispersions excepting that vinyl monomer is introduced into the process and later subjected to a free radical polymerization. The vinyl monomer may be added at several different points in that process, and depending upon which method is employed, a different particle morphology yielding varying final film properties may result. For instance, the vinyl monomer may be used to replace all or part of the solvent used to prepare the prepolymer, with obvious environmental advantages. Vinyl monomer may also be introduced to the prepolymer just after its formation; in both of these cases the monomer is present during the dispersion step. Alternatively, the vinyl monomer may be added after the dispersion step. Combinations of the above may also be employed; however in all of the above free radical polymerization of the vinyl monomer is conducted in the presence of the polyurethane, resulting in some degree of interpenetration of the component polymers. The presence of the hydrophilic groups in the polyurethane backbone eliminate the need for surfactant in the polymerization of the vinyl monomer, with the added advantage that water sensitivity is greatly reduced, though surfactants may still be employed if desired.

Free radical polymerization of the vinyl monomer may be performed in a batch, semicontinuous, or multishot manner, depending upon which method is employed to form the urethane prepolymer. For example, in the case of a prepolymer formed in the presence of vinyl monomer, the initial monomer could be polymerized in a batch process after dispersion in water, followed by a second addition of monomer polymerized in a semicontinuous manner. Alternatively, the second addition could be performed in a single shot and polymerized batchwise. For vinyl monomer introduced to a preformed polyurethane dispersion, the entire process could be conducted semicontinuously until the desired ratio of polyurethane to vinyl polymer is reached. This ratio will also influence final film properties; the useful ratio of vinyl polymer to polyurethane is from 1:9 to 9:1, most preferred from 3:7 to 7:3.

A further improvement can be made on the water repellent properties of the protective overcoat layer of the invention by using water soluble fluorine-containing surfactants conjointly in addition to the above mentioned fluoropolyether. Fluorine-containing surfactants which are preferably used in the present invention include compounds having a perfluoroalkyl or perfluoroalkenyl group which has at least 6 carbon atoms, and which have, as the water soluble group, an anionic group, a cationic group, a betaine group, or a nonionic group. Examples of the fluorine-containing surfactants include, for example, Fluorad FC series manufactured by 3M Company, Zonyl series manufactured by E. I. Du Pont De Nemours & Co., and Fluorotenside FT series manufactured by Bayer AG.

The coating composition in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the dispersible polymer particle, and/or the solution polymer present in the coating composition. Matte particles well known in the art may also be used in the coating composition of the invention, such matting agents having been described in Research Disclosure No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

The coating composition of the present invention may also include lubricants or combinations of lubricants to reduce sliding friction of the imaging elements in accordance with the invention. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly (tetrafluoroethlyene), poly(trifluorochloroethylene), poly (vinylidene fluoride, poly(trifluorochloroethylene-co-vinyl chloride), poly(meth)acrylates, poly(itaconates), or poly (meth)acrylamides containing perfluoroalkyl side groups, and the like. Lubricants useful in the present invention are described in further detail in Research Disclosure No. 308119, published December 1989, page 1006.

The composition of the present invention may be applied as coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weights of 20 $mg/m^2$ to 10 $g/m^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (including pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar—agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September 1994 and Research Disclosure, Item 38957, September 1996 incorporated by reference herein.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September 1994, and Research Disclosure, Item 38957, September 1996 and the references listed therein.

The photographic silver halide emulsions utilized in this invention can contain other addenda conventional in the photographic art. Useful addenda are described, for example, in Research Disclosure, Item 36544, September, 1994 and Research Disclosure, Item 38957, September 1996. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are intended to illustrate the present invention. However, it should be understood that the invention is not limited to these illustrative examples.

EXAMPLES

Protective overcoat layers are prepared by coating the compositions listed in Table 1 at a dry weight of 1000 mg/m$^2$ onto a subbed polyester support that has previously been coated with a Ag-doped vanadium pentoxide antistat layer. Examples 1 has a protective overcoat layer coated from an organic solvent. Example 2 to Example 16 has a protective overcoat coated from water. Advancing contact angles are measured on samples of the coated supports by the tilted plate method using a Rame-Hart Goniometer. The results are listed in Table 1.

TABLE 1

| Example | Protective Overcoat Composition | Advancing Water Contact Angle (degrees) |
|---|---|---|
| Example 1 (Comparative) | Solvent-coated Elvacite 2041[a] | 91 |
| Example 2 (Comparative) | Neorez R960[b]/P-1[c] 40:60 ratio, 5 wt % CX-100[b] | 41.5 |
| Example 3 (Invention) | Neorez R960/P-1 40:60 ratio, 5 wt % CX-100, 0.25 wt % MF-300[d] | 89.5 |
| Example 4 (Invention) | Neorez R960/P-1 40:60 ratio, 5 wt % CX-100, 0.5 wt % MF-300 | 89 |
| Example 5 (Invention) | Neorez R960/P-1 40:60 ratio, 5 wt % CX-100, 1 wt % MF-300 | 91.8 |
| Example 6 (Invention) | Neorez R960/P-1 40:60 ratio, 5 wt % CX-100, 1 wt % Fomblin Fluorolink C[d] | 77 |
| Example 7 (Invention) | Neorez R960/P-1 40:60 ratio, 5 wt % CX-100, 2 wt % Fomblin Fluorolink C | 83.5 |
| Example 8 (Invention) | Neorez R960/P-1 40:60 ratio, 5 wt % CX-100, 2 wt % Fomblin Fluorolink C, 2 wt % FC 430[f] | 78.3 |
| Example 9 (Comparative) | Neorez R960/P-1 40:60 ratio, 5 wt % CX-100, 2 wt % FT-248[e] | 65.8 |
| Example 10 (Comparative) | Neorez R960/P-1 40:60 ratio, 5 wt % CX-100, 2 wt % Zonyl FSN[g] | 40.8 |
| Example 11 (Comparative) | Neorez R960/P-1 40:60 ratio, 5 wt % CX-100, 2 wt % Zonyl FSO[g] | 50 |
| Example 12 (Comparative) | Neorez R960/P-1 40:60 ratio, 5 wt % CX-100, 2 wt % Zonyl FSE[g] | 68.3 |
| Example 13 (Comparative) | Neorez R960/P-1 40:60 ratio, 5 wt % CX-100, 2 wt % Zonyl FSP[g] | 68.3 |
| Example 14 (Comparative) | Neorez R960/P-1 40:60 ratio, 5 wt % CX-100, 2 wt % FC-170[f] | 52.5 |
| Example 15 (Comparative) | Neorez R960/P-1 40:60 ratio, 5 wt % CX-100, 2 wt % FC-171f[h] | 49 |
| Example 16 (Comparative) | Neorez R960/P-1 40:60 ratio, 5 wt % CX-100, 2 wt % Sipex EC-111 Wax[h] | 52 |

[a]Elvacite 2041 polymethylmethacrylate resin is a product of E. I. du Pont de Nemours & Co.
[b]Neorez R960 polyurethane dispersion and CX100 polyaziridine are products of Zeneca Resins.
[c]P-1 is a poly(methyl methylacrylate-co-methacrylic acid) (97/3 weight ratio) latex particle having a mean size of about 80 nm.
[d]Fomblin Fluorolink C and MF-300, carboxylic acid-functional fluoropolyethers, are products of Ausimont USA, Inc. Fomblins were employed as amine salts.
[e]Fluorotenside FT-248, the tetraethylammonium salt of perfluorooctyl sulfonic acid, is a product of Bayer AG. % given is based upon total coating composition weight.
[f]FC-430, FC-170, and FC-171 are fluorocarbon based surfactants manufactured by 3M Company.
[g]Zonyl FSO, FSE, FSP, and FSN are fluorocarbon based surfactants manufactured by E. I. du Pont de Nemours & Co.
[h]Sipex EC-111 Wax Comparative Example 1 has an organic solvent coated protective overcoat layer consisting of poly(methyl methacrylate), and the coating surface shows excellent water repellent properties as indicated by the high water contact angle value. Comparative Example 2 has a protective overcoat layer coated from water and the coating shows poor water repellent properties as indicated by the low water contact angle value. Comparative Examples 9 to 16 contains a protective overcoat coated from water and which contains a fluorine-containing surfactant or a wax, and the coatings show poor water repellent properties. On the other hand, Invention Examples 3 to 8 contains a protective overcoat coated from water and which contains a fluoropolyether compound, and the coatings show excellent water repellent properties.

The invention has been described in detail with particular reference to certain preferred embodiments thereof, but it will be understood that variations and modifications can be effected within the spirit and scope of the invention.

What is claimed is:

1. An imaging element comprising;

a support;

at least one imaging layer superposed on said support; and a protective overcoat superposed on said support, said overcoat formed by coating and subsequent drying of a coating composition comprising a continuous aqueous phase having therein colloidal polymer particles having a glass transition temperature of greater than 20° C. and a fluoropolyether comprising more than 90 mole % units selected from the group consisting of —$CF_2$—$CF_2$—O—, —$CF_2$—O—, —$CF(CF_3)$—O—, and —$CF_2$—$CF(CF_3)$—O—, and a functional group selected from the group consisting of —COOH, —$CH_2$—OH, —$CH_2$—COOH, —$CH_2$—$SO_3H$, —$CH_2$—$PO_3H$, —($CH_2$—$CH_2$—O)—H, and —($CH_2$—$CH(CH_3)$—O—)—H.

2. The imaging element of claim 1 wherein the colloidal polymer particles comprise polyesters, vinyl polymers, polyurethanes, epoxides, polyamides, and polyurethane/vinyl polymer dispersions.

3. The imaging element of claim 1 wherein the colloidal polymer particles have a mean size of greater than 10 nm.

4. The imaging element of claim 1 wherein the coating composition further comprises a water soluble fluorine-containing surfactant.

5. The imaging element of claim 1 wherein the coating composition further comprises a crosslinking agent.

6. The imaging element of claim 1 wherein the coating composition further comprises lubricants, matte particles, crosslinking agents, inorganic fillers, pigments, magnetic particles, antistatic agents and biocides.

7. The imaging element of claim 1 wherein the protective overcoat is superposed on the back surface of the support.

8. The imaging element of claim 1 wherein the protective overcoat is superposed on the front surface of the support.

9. The imaging element of claim 1 wherein the colloidal polymer particles have a core/shell structure.

10. An imaging element comprising;

a support;

at least one imaging layer superposed on said support; and a protective overcoat superposed on said support comprising colloidal polymer particles having a glass transition temperature of greater than 20° C. and a fluoropolyether comprising more than 90 mole % units selected from the group consisting of —$CF_2$—$CF_2$—O—, —$CF_2$—O—, —$CF(CF_3)$—O—, and —$CF_2$—$CF(CF_3)$—O—, and a functional group selected from the group consisting of —COOH, —$CH_2$—OH, —$CH_2$—COOH, —$CH_2$—$SO_3H$, —$CH_2$—$PO_3H$, —($CH_2$—$CH_2$—O)—H, and —($CH_2$—$CH(CH_3)$—O—)—H.

11. The imaging element of claim 10 wherein the colloidal polymer particles comprise polyesters, vinyl polymers, polyurethanes, epoxides, polyamides, and polyurethane/vinyl polymer dispersions.

12. The imaging element of claim 10 wherein the colloidal polymer particles have a mean size of greater than 10 nm.

13. The imaging element of claim 10 wherein the coating composition further comprises a water soluble fluorine-containing surfactant.

14. The imaging element of claim 10 wherein the coating composition further comprises a crosslinking agent.

15. The imaging element of claim 10 wherein the coating composition further comprises lubricants, matte particles, crosslinking agents, inorganic fillers, pigments, magnetic particles, antistatic agents, and biocides.

16. The imaging element of claim 10 wherein the protective overcoat is superposed on the back surface of the support.

17. The imaging element of claim 10 wherein the protective overcoat is superposed on the front surface of the support.

18. The imaging element of claim 10 wherein the colloidal polymer particles have a core/shell structure.

19. An photographic element comprising;

a support;

at least one silver halide imaging layer superposed on said support; and a protective overcoat superposed on said support comprising colloidal polymer particles having a glass transition temperature of greater than 20° C. and a fluoropolyether comprising more than 90 mole % units selected from the group consisting of —$CF_2$—$CF_2$—O—, —$CF_2$—O—, —$CF(CF_3)$—O—, and —$CF_2$—$CF(CF_3)$—O—, and a functional group selected from the group consisting of —COOH, —$CH_2$—OH, —$CH_2$—COOH, —$CH_2$—$SO_3H$, —$CH_2$—$PO_3H$, —($CH_2$—$CH_2$—O)—H, and —($CH_2$—$CH(CH_3)$—O—)—H.

20. The photographic element of claim 19 wherein the protective overcoat is superposed on a back surface of the support.

21. The photographic element of claim 19 wherein the protective overcoat is superposed on a front surface of the support.

* * * * *